US010351993B2

(12) United States Patent
Ammirati et al.

(10) Patent No.: US 10,351,993 B2
(45) Date of Patent: Jul. 16, 2019

(54) MICROFIBROUS FABRIC HAVING A SUEDE APPEARANCE, WITHIN THE COLOUR RANGE OF GREY AND BLACK, WITH A HIGH LIGHT FASTNESS, AND PREPARATION METHOD THEREOF

(71) Applicant: ALCANTARA S.P.A., Milan (IT)

(72) Inventors: Carmine Carlo Ammirati, Terni (IT); Omar Teofrasti, Avigliano Umbro (IT); Walter Cardinali, Cerqueto di Marsciano (IT)

(73) Assignee: ALCANTARA S.P.A., Milan (IT)

( * ) Notice: Subject to any disclaimer, the term of this patent is extended or adjusted under 35 U.S.C. 154(b) by 27 days.

(21) Appl. No.: 15/469,063

(22) Filed: Mar. 24, 2017

(65) Prior Publication Data

US 2017/0198431 A1 Jul. 13, 2017

Related U.S. Application Data

(62) Division of application No. 12/993,213, filed as application No. PCT/IT2008/000739 on Dec. 3, 2008.

(30) Foreign Application Priority Data

Jun. 10, 2008 (IT) ..... MI2008A001055

(51) Int. Cl.

| | |
|---|---|
| ***D01D 5/08*** | (2006.01) |
| ***D01D 5/36*** | (2006.01) |
| ***D01F 8/04*** | (2006.01) |
| ***D01F 8/16*** | (2006.01) |
| ***D06M 15/564*** | (2006.01) |
| ***D06P 3/32*** | (2006.01) |
| ***D06N 3/00*** | (2006.01) |
| ***D06N 3/14*** | (2006.01) |
| ***D01F 8/10*** | (2006.01) |
| ***D01F 8/14*** | (2006.01) |

(52) U.S. Cl.

CPC ..... *D06N 3/0004* (2013.01); *D01D 5/082* (2013.01); *D01F 8/10* (2013.01); *D01F 8/14* (2013.01); *D06N 3/007* (2013.01); *D06N 3/0011* (2013.01); *D06N 3/0036* (2013.01); *D06N 3/0063* (2013.01); *D06N 3/0075* (2013.01); *D06N 3/14* (2013.01); *D06N 3/146* (2013.01); *D06N 3/147* (2013.01); *D06N 3/148* (2013.01); *D06N 2201/0227* (2013.01); *D06N 2203/068* (2013.01); *D06N 2211/00* (2013.01); *D10B 2505/12* (2013.01); *Y10T 428/24994* (2015.04)

(58) Field of Classification Search

CPC .... D01D 5/08; D01D 5/36; D01F 8/04; D01F 8/16; D02J 3/02; D06M 15/564; D06N 3/0004; D06N 3/0036; D06N 3/0063; D06N 3/0075; D06N 3/14; D06N 3/146; D06N 3/147; D06N 3/148; D06P 3/32

USPC ..... 264/78, 129, 136, 137, 162, 172.13, 264/172.17, 211, 211.16

See application file for complete search history.

(56) References Cited

U.S. PATENT DOCUMENTS

| | | | | |
|---|---|---|---|---|
| 3,531,368 | A | 9/1970 | Okamoto et al. | |
| 3,716,614 | A | 2/1973 | Okamoto et al. | |
| 4,146,663 | A | 3/1979 | Ikeda et al. | |
| 7,144,535 | B2 | 12/2006 | Bellucci et al. | |
| 7,282,253 | B2 | 10/2007 | Marini et al. | |
| 2002/0114919 | A1* | 8/2002 | Yoneda | D06N 3/004 428/91 |
| 2003/0151154 | A1 | 8/2003 | Bellucci et al. | |
| 2003/0232555 | A1* | 12/2003 | Nobuto | D06N 3/0063 442/136 |
| 2004/0063366 | A1 | 4/2004 | Nakayama et al. | |
| 2005/0084719 | A1* | 4/2005 | Yoshimoto | D06N 3/0004 422/105 |
| 2005/0118394 | A1 | 6/2005 | Tanaka et al. | |
| 2005/0136228 | A1 | 6/2005 | Marini et al. | |
| 2006/0217497 | A1* | 9/2006 | Kitada | C08G 18/0823 525/453 |

(Continued)

FOREIGN PATENT DOCUMENTS

| | | |
|---|---|---|
| EP | 0584511 A1 | 3/1994 |
| EP | 1323859 A | 7/2003 |

(Continued)

*Primary Examiner* — Leo B Tentoni

(74) *Attorney, Agent, or Firm* — Jeffrey N. Townes; Cozen O'Connor

(57) ABSTRACT

An artificial leather having a suede appearance and colors within the grey-black range and high color fastness comprising a microfibrous component and an elastomeric matrix; the microfibrous component consisting of polyester microfibers having a count of 0.01 to 0.50 dtex; the elastomeric matrix consisting of polyurethane consisting of soft and hard segments; the ratio between the elastomeric matrix and the microfibrous component ranging from 20/80 and 50/50 by mass; the microfibrous component containing carbon black pigment in a percentage of 0.05 to 2.00% by mass; the elastomeric matrix containing carbon black pigment in a percentage of 0 to 10% by weight; the carbon black always having an average dimension smaller than 0.4 microns. The average length of the tassel is between 200 and 500 microns. The soft segments consist of at least one polycarbonate diol selected from polyalkylene carbonate diols and at least one polyester diol. The hard segments consist of urethane groups deriving from the reaction between free isocyanate groups and water. The total content of carbon black is between 0.025 and 6% by weight.

17 Claims, No Drawings

(56) References Cited

U.S. PATENT DOCUMENTS

2010/0068516 A1* 3/2010 Yoon ..... D01F 1/10
428/372

FOREIGN PATENT DOCUMENTS

| | | | |
|---|---|---|---|
| EP | 1403421 | A | 3/2004 |
| EP | 1431448 | A1 | 6/2004 |
| EP | 1536056 | A | 6/2005 |
| IT | 1097917 | B | 8/1985 |
| IT | 1256230 | | 11/1995 |
| JP | 2004315987 | A | 11/2004 |
| JP | 2005133256 | A | 5/2005 |

* cited by examiner

MICROFIBROUS FABRIC HAVING A SUEDE APPEARANCE, WITHIN THE COLOUR RANGE OF GREY AND BLACK, WITH A HIGH LIGHT FASTNESS, AND PREPARATION METHOD THEREOF

This application is a Divisional of U.S. patent application Ser. No. 12/993,213, filed Nov. 17, 2010, which is a 35 U.S.C. § 371 National-Stage of International PCT Application No. PCT/IT2008/000739, filed Dec. 3, 2008, which claims priority to Italian Patent Application No. MI2008A001055, filed Jun. 10, 2008, all of which are herein incorporated by reference in their entirety.

The present invention relates to a high-quality artificial leather, having a suede appearance and colours within the range of grey and black, characterized by an high colour fastness when exposed to light and a long durability, destined for use in car interiors.

The definition "high fastness" means high resistance of the colour shade to undergoing variations following prolonged exposure to light.

The definition "high durability" means high resistance of the suede leather, capable of lasting for long periods of time, even following long and repeated exposure to light and particularly oxidizing and/or hydrolyzing environments.

The process necessary for producing artificial leather with a high fastness is also part of the present invention.

The synthetic leather with a suede appearance, object of the present invention, even if characterized by the properties of high fastness to light and a long durability, can be compared, in its most general characteristics, to already known composite structures consisting of a surface having a high microfibre density and a matrix of the elastomeric type binding the same microfibre structure. The methods already used for the production of high-quality synthetic leathers having a suede effect (see, for example, EP-A-0584511, EP-A-1323859, U.S. Pat. Nos. 7,144,535, 3,531,368, 3,716,614) are all characterized by a process which can be schematized as follows:

A1) Spinning of a bi-component fibre of the "sea-island" type, in which the "island" component consists of a polyester and/or polyamide and the "sea" component of a polymer immiscible in the island component and capable of dissolving in suitable solvents of an organic or inorganic nature. The micro-fibres obtained after dissolution of the sea component have counts typically lower than 0.5 dtex.

A2) Preparation of a felt characterized by well-defined density values and a unitary weight, by means of a mechanical needling process capable of connecting the microfibres obtained in item A1.

A3) Impregnation of the felt with a binder capable of withholding the "islands" during the subsequent elimination phase of the "sea" component. Said binder, which also has the function of suitably reinforcing the felt to such an extent as to allow its immersion in the solvent used for eliminating the "sea", can be of two different typologies.

The first is typically based on polyvinyl alcohol, which is removed in a subsequent step of the process.

The second is typically based on polyurethane which partially or totally remains in the final product, even after the subsequent process steps.

A4) Dissolution of the "sea" component in a suitable organic (generally trichloroethylene) or inorganic (acidic or basic aqueous solution, or simply in hot water) solvent to give the microfibrous material.

A5) Impregnation of the above-mentioned microfibrous material with a polyurethane (PU) solution in organic solvents (dimethyl formamide, DMF); as an alternative, said impregnation can be effected with polyurethane in emulsion or aqueous dispersion (PUD).

A6) Elimination of the binder used in point A3 if the binder is not PU or PUD and of the solvent possibly used in step A5.

A7) The microfibrous material impregnated with polyurethane is cut into two equal portions, by means of a longitudinal cut, parallel to the surfaces.

A8) Grinding of the surfaces of the product by means of suitable treatment with abrasive papers, in order to confer the suede appearance to the structure.

A9) Final dyeing of the product.

A10) Finishing treatment (coupling with other substrates, printing, etc.).

With reference to the dyeing process, it should be pointed out that the methods generally used for dyeing non-woven fabrics based on polyester, include dyeing the microfibrous component (tassel) by immersion of the material in baths containing dyes of the "dispersed" type. The use of dispersed dyes only, does not require any dyeing of the polyurethane matrix which therefore maintains its original colour as it cannot be solidly dyed using this group of dyes. The dyeing process is concluded by a reducing cleaning step carried out by means of sodium hydrosulphite in NaOH, with the aim of removing the excess of dyes still present and unfixed on the material.

The colouring difference between tassel and polyurethane matrix is normally critical, as the visibility of the background influences negatively the aesthetical impact of the final product.

In order to minimize the above-mentioned colour difference between tassel and polyurethane matrix, various countermeasures are normally adopted:

addition of organic or inorganic pigments to the polyurethane itself, before the impregnation process;

resort to a second dyeing bath after the standard bath described above, in which so-called "pre-metallized" dyes are used, capable of dyeing the polyurethane base and thus limiting the deterioration in quality attributable to the colour difference (see patents IT 1097917, IT 1256230);

optimization of the tassel length, in order to find the correct compromise between "coverage" of the PU background, imitation of real suede leather and protection of the writing and mottling effects: an excessively short tassel, in fact, it does not reduce the visibility of the PU on the "noble" surface of the product and decreases its qualitative level because it reduces both two effects mentioned above.

With reference to the last aspect described, it should be noted that, due to its high surface density, the micro-fibrous component strongly characterizes the quality of the "visible" side of synthetic leathers with a suede appearance, contributing, much more than the binding matrix, to the conferment of properties such as colour shade, mottling, the writing effect and soft feel, which represent the main parameters for a qualitative evaluation of this type of non-woven fabric.

The products obtained as describe above, normally have some limits in the invariability of the colour shade after light exposure. This limited colour fastness to light significantly conditions the applicative potentialities, in particular to the field of car interiors, which represents one of the reference markets for high-quality synthetic leathers which are widely used in the lining of car interiors.

For this reason, the colour fastness after exposure to light of synthetic leathers is carefully evaluated by means of various analytical methods which comprise the exposure of test samples to artificial light sources under controlled irradiation and humidity conditions.

Unfortunately, there is currently no single analytical method for the evaluation of colour fastness to light and each car producer adopts a specific method. Normally the various methods use Xenon lamps in order to reproduce the solar irradiation spectrum as accurate as possible; the irradiation spectrum can also include radiations with wave-lengths ranging from 270 to 700 nm and the temperature of the exposure chamber can reach 60-70° C.

In Europe, the most widely-used methods are DIN 75 202 PV 1301, D47 1431 and SAE J1885. In the USA market the most widely-spread method is FLTM BO116-01 in addition to SAE J1885. The following table shows the main test conditions:

| Method | Apparatus | Lamp | Black panel | Chamber temperature | Humidity | Exposure time | Irradiation |
|---|---|---|---|---|---|---|---|
| DIN75202 PV 1303 | Xenotest Beta (Heraeus) | Xenon | 100 ± 2° C. | 65 ± 5° C. | 20 ± 10% | 1, 2 and 3 Fakra cycles | 60 W/m$^2$ 300 + 400 nm |
| D47 1431 | Atlas CI3000 (Heraeus) | Xenon | 100 ± 2° C. | 66° C. + 2° C. | 30 ± 10% | 150 hrs | 1.4 W/m$^2$, 420 nm |
| SAEJ1885 | Atlas CI3000 (Heraeus) | Xenon | light 89 ± 2° C. dark 38 ± 2° C. | 62 ± 2° C. 38 ± 2° C. | 50 ± 5% 95 ± 5% | 225.6 KJ/m$^2$ | 0.55 W/m$^2$, 340 nm |
| | | | light 89 ± 2° C. dark 38 ± 2° C. | 62 ± 2° C. 38 ± 2° C. | 50 ± 5% 95 ± 5% | 488.8 KJ/m$^2$ | 0.55 W/m$^2$, 340 nm |
| FLTM BO116-01 | Atlas CI4000 | Xenon + auxiliary lamp | light 89 ± 2° C. dark 38 ± 2° C. | 62 ± 2° C. 38 ± 2° C. | 50 + 5% 95 ± 5% | 451-902 KJ/m$^2$ | 1.06 W/m$^2$, 420 nm |
| | | | light 89 ± 2° C. dark 38 ± 2° C. | 62 ± 2° C. 38 ± 2° C. | 50 ± 5% 95 ± 5% | 942-3224 KJ/m$^2$ | 1.06 W/m$^2$, 420 nm |

The evaluation of the colour fastness to light is effected by comparing the colour variation before and after exposure with the grey scale ISO 105A02.

Various countermeasures are now adopted in order to maximize the resistance of the colour shade following exposure to light. One of the most common and efficient is to add organic or inorganic pigments to the polymer used for the production of microfibres, upstream of the spinning phase (mass dye technology).

The mass dye technology does in fact allows the use of organic or inorganic pigments having a high fastness to light, which cannot normally be applied in water bath dyeing.

For the classical dyeing of polyester, in fact, it is only possible to use organic dyes, dispersible in water, capable of being diffused inside the polyester fibre. In the case of the dyeing of a polyester microfibre, it is necessary to provide of molecules having small dimensions in order to obtain good dyeing yields in a short time.

The use of additional polymers with pigments in the spinning process, however, has also considerable drawbacks, such as:

increase in the obstruction process of the filtering screens situated upstream of the spinnerets for protective purposes. The acceleration of the obstruction phenomena implies an increase in the frequency with which the filter screens must be substituted and therefore a considerable increase in the production costs;

decrease in the mechanical properties of the micro-fibrous component of the fibre with a consequent reduction of the mechanical properties of the synthetic leather produced with it.

In order to limit the drawbacks listed, an accurate selection of the pigment used is necessary, with particular reference to the dimensions of its particles and to its filterability, as well as the percentage of its addition to the polymer. It should in fact be considered that higher pigment contents allow the production of synthetic fibres characterized by deeper colour shades but they also imply more frequent obstructions of the filtering systems positioned for the protection of the spinnerets and greater reductions in the mechanical properties of the same fibres.

The production of high-quality synthetic leathers therefore requires an optimal compromise between the two mentioned factors, also resorting to alternative solutions, when necessary, for obtaining a certain colour shade. As the "overall" colour shade of a synthetic suede leather can be attributed to both the microfibrous (main) component and to the polyurethane matrix, one of the possible known solutions for obtaining dark colours is to limit the micro-fibrous tassel length, so as to only partially cover the polyurethane base and to profit by the contribution of its "background" colour to obtain the desired colour shade (see patent EP 1403421 in which the tassel length is from 10 to 200 μm). The expedient described above, however, has also serious drawbacks as it strongly conditions the qualitative level of the synthetic leather due to the limited writing and mottling effect obtained by means of a reduced length of the tassel.

The measurement of the colour shade is normally carried out by instrumental reading of the colour and by visual comparison with a reference standard (mainly in the case of synthetic leather with a suede appearance such as that object of the present invention). Instruments and reading techniques are well-known to experts in the field. The need for a visual comparison is due to the different sensitivity of the human eye with respect to the instruments on the market, but, above all, to the specific surface of these types of materials which are characterized by the presence of tassels, which leads the eye to perceive different colour shades according to the inclination of the microfibre with respect to the observer. Several models have been prepared in order to reproduce, by means of instrumental analyses, the same colour perception of the human eye. One of the most simple and widespread is called CIELAB system. This system is based on the representation of colours by means of three coordinates defined by the letters L, a and b, arranged in a Cartesian reference system. L represents luminosity and can have values from 100 (white) to 0 (black), whereas the other two coordinates (a, b), perpendicular to the former, identify the chromaticity of the colour and can have values ranging from +80 to −80: negative values for a denote the presence of a green component; positive values of a red component; negative values for b denote the presence of a blue component; positive values of a yellow component. The colour difference between two measurements can be expressed as Cartesian distance between the coordinates relating to the two measures. Even if this model has not yet substituted visual comparison with respect to a standard sample effected by an expert (mainly during the formulating phase of the colour formulation), it is very useful in the preliminary evaluation of the material analyzed and for providing an assessment term in the discussion and comparison with other subjects (such as customers and suppliers).

In addition to the property of colour fastness to light, all high-quality synthetic suede leathers, in order to be widely used, must have a high and long-lasting mechanical resistance. This characteristic, commonly identified as "durability" can be evaluated by subjecting the synthetic leather to aging according to two types of tests:

- UV aging, carried out in a particular apparatus (Xenotest β) under well-defined conditions of relative humidity (20±10%), temperature (100±3° C.), irradiation (60 W/m$^2$) and time (138 hours), corresponding to a duration cycle of 3 fakra.
- hydrolyzing aging (Jungle test) carried out in a climatic camera under well-defined conditions of temperature (75±1° C.), relative humidity (90±3%) and duration (5-7-10 weeks).

The aging of the material is then analyzed in terms of variation of appearance, abrasion resistance, variation of the physical-mechanical properties and, with respect to the polyurethane matrix only, variation of average Molecular Weights of the polymeric chains.

At present, the objective of a satisfactory durability of synthetic leathers has already been reached by using suitable polyurethane matrices, characterized in that they include "hard" segments, consisting of urethane and/or ureic groups (obtained from the reaction between free isocyanate groups and water) and "soft" segments consisting of a mixture of polycarbonate-diols/polyester-diols in a ratio ranging from 80/20 to 20/80 (see U.S. Pat. No. 7,144,535).

So far, polyurethane matrices capable of conferring properties of high durability, have never been used for the production of synthetic leather also characterized, by a high colour fastness to light obtained by the addition of pigments to the molten polymer used for the production of the microfibre.

An object of the present invention is to provide a high-quality artificial leather with a suede appearance mainly intended to use in the field of car interiors, with colours in the range of grey and black, at the same time having a high fastness to light and a long durability.

It has been discovered that, by suitably combining the right quantitative ratios, according to the colour shade to be dyed, the use of carbon black in the micro-fibre, with the possible use of the same carbon black in the matrix, a polyurethane matrix suitably selected and a tassel length within a well-defined range, it is possible to provide a processing intermediate which, when subsequently over-dyed with the addition of dispersed dyes, in the colours within the grey and black range, can produce an artificial leather with a suede appearance capable of complying with the requirements of light fastness, durability, appearance and feel required in the field of car interiors.

The present invention therefore relates a high-quality artificial leather with a suede appearance and within the range of grey and black colours, the colour fastness to light, according to the method SAE J 1885 225.6 KJ/m$^2$ being higher than or equal to 4; the colour fastness to light, according to the method SAE J 1885 488.8 KJ/m$^2$ not being lower than 3; said artificial leather having a tassel on the surface of the leather itself; said artificial leather comprising a microfibrous and an elastomeric matrix; the above microfibrous component consisting of polyester microfibres, preferably of polyethylene terephthalate, having a count of 0.01 to 0.50 dtex; said elastomeric matrix consisting of polyurethane; said polyurethane being made up of soft segments and hard segments; the ratio between the elastomeric matrix and the micro-fibrous component ranging from 20/80 to 50/50 in mass; the microfibrous component containing the carbon black pigment in a percentage of 0.05 to 2.00% in mass, preferably from 0.15 to 1.50%; the elastomeric matrix containing the carbon black pigment in a percentage of 0 to 10% by weight, preferably from 0 to 7% by weight, even more preferably from 0.02 to 6% by weight; the carbon black always having an average dimension lower than 0.4 microns; said artificial leather being characterized by:

(a) the average length of the tassel ranges from 200 to 500 microns, preferably from 210 to 400 microns;
(b) the soft segments consisting of at least one polycarbonate diol selected from polyalkylene carbonate diols and at least one polyester diol;
(c) the hard segments consisting of urethane and/or ureic groups, the latter deriving from the reaction of free isocyanate groups and water;
(d) the total carbon black content ranges from 0.025 to 6% by weight, preferably from 0.075 to 4.25% by weight, even more preferably from 0.085 to 3.75% by weight.

The high quality of the artificial leather with a suede appearance of the present invention is associated with a complex set of technical-sensorial factors among which an evident superficial mottling, a high writing effect, a particularly soft and pleasant feel. These effects are mainly due to the microfibrous component (tassel) of the artificial leather, with particular reference to its surface density and length, from 200 to 500 microns, preferably from 210 to 400 microns. An excessively short and/or low-density tassel, would not allow a complete covering of the polyurethane background, with a consequent qualitative decrease in the noble surface of the product, from both aesthetical and sensorial point of view. On the other hand, an excessively long tassel would contribute to reduce the quality of the synthetic leather as it would be responsible for a "poor" appearance, unlike natural suede products.

Another fundamental characteristic of the artificial leather with a suede appearance of the present invention, is its high aging resistance, capable of lasting for long periods of time, even after long and repeated exposure to light and to particularly oxidizing and/or hydrolyzing environments, without jeopardizing the characteristic of softness conferred by the microfibrous component. This result has been obtained by using the particular polyurethanes of the present invention, characterized by soft and hard segments.

The durability of the suede leather of the present invention proves to be ≥3 (internal reference photographic standards) in terms of abrasion resistance, after aging under UV rays or after hydrolyzing aging. Furthermore, there is a retention of 80% of the physical-mechanical characteristics after UV aging or hydrolyzing aging.

All these properties are described in more detail in the experimental section.

As far as the components of the artificial leather of the present invention are concerned, the microfibrous component consists of microfibres of one or more polymers selected from polyethylene terephthalate, polytrimethylene terephthalate, polybutylene terephthalate, preferably polyethylene terephthalate.

With respect to the elastomeric matrix, this consists of polyurethane. This term (polyurethane) refers to both real polyurethanes and also polyurethane-ureas. The polyurethanes are characterized by the presence of urethane bonds, formed, for example, by the reaction between isocyanate groups and hydroxyl groups, whereas the polyurethaneureas also contain ureic bonds obtained, for example, from the reaction of isocyanate groups and amines or water.

The polyurethanes are made up of soft segments and hard segments. The soft segments consist, at least, of one polyalkylene carbonate diol and, of one polyester diol.

Typical examples of polyalkylene carbonate diols are polytetramethylene carbonate diol (PTMC), polypentamethylene carbonate diol (PPMC), polyhexamethylene carbonate diol (PHC), polyheptamethylene carbonate diol, polyoctamethylene carbonate diol, polynonamethylene carbonate diol, polydeca methylene carbonate diol, poly-(3-methyl-pentamethylene carbonate) diol (PMPC), poly-(2-methyl-pentamethylene carbonate) diol, poly-(2-methyl-1-octamethylene carbonate) diol.

The polymeric diols used for the synthesis of the polyurethanes described in the examples of the experimental part, normally have a numeral average molecular weight ranging from 1,000 to 3,000, preferably between 1,750 and 2,250.

The hard segments refer to portions of polymeric chains deriving from the reaction of an organic diisocyanate such as, for example, methylene-bis-(4-phenyl isocyanate) (MDI) or toluene diisocyanate (TDI) with a diamine or glycolic chain. It is in fact well-known that the completion of the polyurethane synthesis can be effected by means of diamines, thus obtaining polyurethane-ureas, or with glycols, obtaining, in this way, polyurethanes in the true sense.

Diamines possibly used as chain extenders in the production of polyurethane-ureas are, among aliphatic diamines, ethylenediamine (EDA), 1,3-cyclohexanediamine (1,3-CHDA), 1,4-cyclohexanediamine (1,4-CHDA), isoforondiamine (IPDA), 1,3-propylenediamine (1,3-PDA), 2-methylpentamethylenediamine (MPDM), 1,2-propylenediamine (1,2-PDA) and blends thereof. Typical examples of aromatic diamines to be used as chain extenders are 3,3'-dichloro-4,4'-diaminodiphenyl methane, methylene-bis(4-phenyl amine) (MPA), 2,4-diamino-3,5-diethyl toluene, 2,4-diamino-3,5-di(methylthio)toluene. The above amines can be added as such or produced in situ by reaction of the corresponding isocyanate and water.

The chain extension in polyurethanes in the true sense, can also be obtained with diols such as ethylene glycol, tetramethylene glycol and mixtures thereof. Finally, the chain extension can also be obtained with dicarboxylic acids such as malonic acid, succinic acid, adipic acid.

The hard segments can also include molecules with a hydrophilic nature and/or charged molecules, capable of making the polyurethanes easily dispersible or emulsifiable in water, both in absence and in presence of external surface-active agents. Among molecules having negatively charged groups capable of facilitating the dispersion of the polymer in water, 2,2-dimethylol-propanoic acid, 2,2-dimethylol-butanoic acid, compounds functionalized with sulphonic groups, can be mentioned. Among molecules having positively charged groups diethanol amine, N-methyl-diethanolamine and, in general, dihydroxy alkyl amines, diamino-alkyl amines and the salts of quaternary ammonium, can be mentioned. Among molecules of a hydrophilic nature, polyoxyalkyl ethers are included.

The reactions used for preparing polyurethanes and polyurethane-ureas are normally carried out in inert, aprotic solvents, such as dimethyl acetamide (DMAc), dimethyl formamide (DMF), N-methyl pyrrolidone (NMP), acetone, methyl-ethyl-ketone (MEK). Alternatively, the process can be carried out by dispersing or emulsifying the synthesis intermediates in an aqueous environment or a mixture of water and suitable surface-active agents; a further alternative of the process can be to synthesize the polymers or their intermediates in a solvent, subsequently dispersing the same in water or a mixture of water with suitable surfactants, finally removing the solvent by evaporation.

The polymers thus produced can also be subjected to cross-linking to be carried out in emulsion or dispersion, or after application to the non-woven fabric, with the purpose of increasing its resistance to the process conditions and/or with the purpose of conferring to the impregnated non-woven fabric, higher resistance characteristics to the action of atmospheric agents and solvents.

As far as the carbon black is concerned, this pigment is characterized by the very reduced dimension of its elemental particles (normally smaller than 0.4 microns) and by their good dispersibility (necessary for avoiding an excess aggregation of the same elemental particles, with consequent fluctuation of the colour and decrease in the physical-mechanical properties of the polymer). As is known, carbon black is a black pigment which can be used for conferring colourings within the grey/black range to synthetic fibres, whose intensity is in relation to the concentration of pigment in the polymer and yarn count (denier) of the fibres. In particular, deeper colour shades can be obtained by increasing the percentage of the pigment in the polymer and/or increasing the count of the fibres. The pigment is present in the microfibrous component in quantities ranging from 0.05 to 2.0% by weight, and it is present in the elastomeric component in a quantity of 0 to 10% by weight, in relation to the final colour desired. By changing the quantity of carbon black in the microfibre and/or in the elastomeric portion, it is possible to obtain a large range of colour shades within light greys and blacks.

This limit, from the colour point of view, does not effect the field of car interiors, a particularly difficult field where high light fastness is required, but where the chromatic request is strongly concentrated within the range of grey and black. Recent data relating to the European, American and Asian markets, indicate the following colour requests for synthetic leather with a suede appearance:

grey-black shade: 60-80%
beige shade: 15-30%
other shades: 5-10%.

In any case, the total quantity of carbon black in the artificial leather according to the present invention, is from 0.025 to 6%, preferably from 0.075 to 4.25%, even more preferably from 0.085 to 3.75% by weight, otherwise the mechanical properties would decrease.

The present invention also relates to a process of production of artificial leather with a suede appearance, with colours within the range of grey and black as defined above, comprising the following steps:

(1) production of a microfibrous intermediate product consisting of microfibres with the addition of carbon black, said carbon black being contained in the microfibre in a quantity of 0.05% to 2% by weight, preferably from 0.15 to 1.50% by weight, said microfibres being selected from microfibres of polyethylene terephthalate, polytrimethylene terephthalate, polybutylene terephthalate, said microfibrous intermediate being obtained by the spinning of fibres obtained by extrusion of a polymer among those indicated above (defined as island component) with the addition of carbon black, said carbon black having an average particle-size lower than 0.4 microns, and a binding polymer of the microfibres (sea component) which is subsequently eliminated during the processing steps by extraction with an organic solvent;

(2) impregnation of the microfibrous intermediate product with the addition of carbon black as per item (1), with a solution and/or dispersion comprising one or more polyurethanes and carbon black, the latter being present in a quantity of 0 to 10% by weight, preferably from 0 to 7% by weight, even more preferably from 0.02 to 6% by weight with respect to the polyurethane, and having an average particle-size lower than 0.4 microns; the weight ratio between polyurethane and the microfibrous intermediate ranging from 20/80 to 50/50 in mass; said polyurethane being made up of soft segments and hard segments, said soft segments consisting of at least one polyalkylene carbonate diol and at least one polyester diol; said hard segments consisting of urethane and/or ureic groups deriving from the reaction between free isocyanate groups and water; subsequent elimination of the solvent to give a raw semifinished product;

(3) grinding of the surface of the above raw semifinished product to give synthetic leather with the characteristic of a suede appearance, the length of the tassel of the above-mentioned synthetic leather being from 200 to 500 μm, preferably from 210 to 400 μm.

Step 1 initially comprises (step 1a) the preparation of a microfibrous intermediate consisting of microfibres of one or more polymers selected from polyethylene terephthalate, polytrimethylene terephthalate, polybutylene terephthalate, preferably polyethylene terephthalate, with the addition of carbon black. In order to improve the mechanical properties of the fibres obtained with the above, these polymers may be preliminarily subjected to a post-polymerization process in solid state, to increase the length of the polymeric chains.

The production of the microfibres includes the spinning of multicomponent fibres by extrusion of a polyester among those mentioned above (defined as island component) with the addition of carbon black, in percentages ranging from 0.05÷2.00%, preferably 0.15÷1.50% with a polymer binding the microfibres, which is then eliminated during the subsequent working steps (sea component).

In another preferred embodiment, the production of the above microfibres can be effected by using a suitable mixture of two polyesters selected from those listed above, one of which, defined as masterbatch, contains carbon black in a percentage ranging from 10 to 50%. To avoid jeopardizing the physical-mechanical properties of the fibre, and making the following processing phases difficult, it is preferable for said master-batch to have an Inherent Viscosity value (I.V.) not lower than the other polymer one. This can be achieved by subjecting said masterbatch to polymerization in the solid state. More specifically, the optimum percentages of pigment added to the microfibre have been selected with the aim of:

- achieving a considerable enhancement in the light fastness;
- obtaining a wide range of shades between light grey to black (also using a final over-dyeing treatment of the fibres themselves);
- obtaining a high reproducibility of the colour through the precise definition of the formulations in the final over-dyeing step;
- reducing the consumption of dispersed dyes in the over-dyeing step;
- minimizing the problems of obstruction of the spinneret;
- minimizing the fibre types to produce with a different pigment content (in order to minimize the production costs).

In the most typical cases, the binding polymer (sea component) consists of polystyrene or a modified polyester or a polymer of the family of polyhydroxyalcanoates. The above-mentioned binder must, in any case, be immiscible with the polymer forming the microfibrous component and must be present in percentages between 10-90% by weight (preferably 15-50%). The structure of the microfibre/binder system, is preferably of the "island-sea" type: the overall section of the fibre after spinning (sea+islands) is circular and contains circular islands (micro-fibres with the addition of carbon black) in its interior, surrounded by the sea (binder) which holds and keeps the islands separate from each other.

As an alternative to the technology described, the fibres, after spinning, can have elongated or trilobated hollow sections.

The distribution of the bi-component in the section can also be "radial" type (with alternating components "in segments" in a circular section), "skin-core" (with the microfibrous component surrounded by an external crown consisting of the binder) or multi-layers (with the two components forming parallel and alternating layers).

The fibre collected under the spinneret is then drawn according known technologies and finally crimped and cut in order to produce staple fibre.

The stretching ratio normally applied is within the range of 2.1÷5.1.

The crimp number is between 4÷15 per centimeter.

The staple fibre normally has a count within the range of 1.5÷11.0 dtex, preferably between 2.7÷6.7 dtex; a length between 30÷150 mm preferably between 30÷100 mm.

An intermediate felt is produced (step 1b) with a non-woven structure, by means of mechanical needle punching or by water jet punching of the microfibrous intermediate containing carbon black prepared in step (1a). The felt intermediate has density values within the range of 0.150÷0.350 g/cm$^3$, typically between 0.150÷0.200 g/cm$^3$ and Unitary Weights within the range of 550÷950 g/m$^2$, typically between 570÷630 g/m$^2$.

The felt intermediate is impregnated according point A3) of the known production method of synthetic leathers with a suede appearance already described. The "sea" component of the bi-component fibres is then dissolved according to point A4) of the same production method.

Step 2 consists in the impregnation of the micro-fibrous intermediate containing carbon black produced in step 1) with a solution and/or dispersion comprising one or more polyurethanes and, if necessary, carbon black. Said impregnation is effected using one or more solutions of one or more polyurethanes in organic solvents, for example dimethyl formamide. Alternatively, this impregnation can be effected with one or more polyurethanes in an emulsion or water dispersion. As far as the polyurethane is concerned, information should be caught in the product claim.

The subsequent operation consists of eliminating the solvent and/or dispersant and/or emulsifying agent, previously used and eliminating the binder possibly used in item A3), thus obtaining a "greige" type intermediate product. The latter is subjected to grinding to "extract" the tassel from the polyurethane matrix in which it has been impregnated, in order to confer a microfibre length of 200 to 500 microns, preferably from 210 to 400 microns, to the synthetic suede leather of the present invention.

The suede leather thus obtained can be subjected to a further dyeing step, preferably effected in a "circular" dyeing apparatus, equipped with a Venturi nozzle, for example the equipment of Hisaka Works ltd.

The dyeing cycle consists of a first dyeing step, in which the "greige" type intermediate product is put in contact with a mixture of dispersed dyes, surface-active agents, which disperse the dye and facilitate its contact with the fibre, pH conditions suitable for allowing the dye to penetrate inside the same fibre and dyeing auxiliaries. The maximum dyeing temperature, normally between 100÷140° C., is selected so as to heat the polymers forming the micro-fibres above their glass transition temperatures, thus facilitating the diffusion of the dye in the polymer. In practice, the "greige" type intermediate is circulated in the dyeing equipment for about 1 hour at the maximum dyeing temperature and, subsequently, subjected to cleaning treatment with sodium hydrosulphite in a basic environment.

A great advantage for the process of the present invention regards the dye amount consumption. With the same final colour (from grey to black) of the suede leather of the present invention, the process described above allows a lower consumption of dispersed dyes, because the product to be dyed already has a grey shade due to the presence of carbon black. Furthermore, the lesser use of dispersed dyes (or their total absence) as a result of a colouring due to carbon black, allows the suede leather of the present invention to have a high colour fastness to light.

For illustrative purposes, a preferred but non-limiting version of the overall process including the present invention, is schematized hereunder.

B1) Feeding of a mixture consisting of chips of virgin polymer, typically PET and chips of masterbatch (polymer, typically PET, with the addition of carbon black) to a spinning line. The masterbatch, with a high content of carbon black, is quantitatively added to the virgin polymer so that, downstream of the extrusion process, the content of the pigment dispersed in the microfibrous component is within the range mentioned above.

B2) Spinning of a hi-component fibre effected by means of the well-known spinning technology of the "sea-island" type, wherein the "sea" component consists of polystyrene and the "island" component consists of polyethylene terephthalate with the addition of carbon black. The "islands" thus produced form so-called microfibres "dyed in mass", having counts typically falling within the range of 0.10÷0.20 dtex.

B3) Preparation of an intermediate felt, typically by means of a mechanical needle punching process, with the fibres obtained as described in the previous item. The intermediate felt has a preferable density within the range of 0.150÷0.200 g/cm$^3$ and Unitary Weights within the range of 580÷630 g/cm$^2$.

B4) Processing of the intermediate felt according to the process described in items A3-A4-A5-A6-A7-A8 of known high-quality synthetic suede leathers, with particular attention, in point A8, effecting the grinding with such conditions able to confer to the microfibre tassel in the product a length ranging from 200 and 500 microns.

B5) Final overdyeing of the microfibrous component forming the synthetic leather with a suede appearance, by means of technologies traditionally used for the achieving of the desired final colour shade.

The following examples are provided for a better understanding of the present invention.

EXAMPLES

The following table indicates the abbreviations used for identifying the raw materials in the examples

| ABBREVIATIONS | RAW MATERIAL |
|---|---|
| c.b. | Carbon black |
| PET | Polyethylene terephthalate |
| PS | Polystyrene |
| PVA | Polyvinyl alcohol |
| DMF | N,N-Dimethylformamide |
| PHC | Polyhexamethylene carbonate glycol |
| PNA | Polyneopentyladipate glycol |
| MDI | 4-4' Diphenylmethanediisocyanate |
| DBA | N,N-Dibutylamine |

Comparative Example 1 (Standard Product)

A bi-component fibre of the "island-sea" type is produced by extruding a pair of polymers insoluble with respect to each other.

The polymers used are PET and PS, which are extruded and spun to produce a fibre whose sea component consists of PS and the island component PET. The PET has an I.V. value equal to 0.7 dl/g. The fibre thus obtained has the following characteristics:

1. Yarn count: 4.2 dtex
2. Length: 51 mm
3. Maximum load strength: 2.08 g/dtex
4. Maximum load elongation: 62%
5. Crimp number: about 4-5/cm
6. PET microfibre strength at maximum load: 3.89 g/dtex
7. PET micro-fibre elongation at maximum load: 72%

In particular, the fibre is made up of 57 parts by weight of PET and 43 parts by weight of PS. The fibre, if observed in section, reveals the presence of 16 PET micro-fibres englobed in the PS matrix.

An intermediate felt is prepared with the bi-component fibre, subjected to needling to form a needled felt having a density within the range of 0.180÷0.200 g/cm$^3$ and a Unit Weight within the range of 580÷630 g/m$^2$.

The white-coloured needled felt (coordinate CIELAB L equal to 96.3), is immersed in a water solution at 20% weight of polyvinyl alcohol and then subjected to drying. The needled felt thus treated is subsequently immersed in trichloroethylene until the complete dissolution of the polystyrene matrix of the fibres. The non-woven fabric formed is then dried, obtaining an intermediate product called "semi-finished product D" (coordinate CIELAB L, after removal of the sea component, equal to 96.6).

A polyurethane elastomer is prepared separately, in the form of a solution in DMF. In a first step (pre-polymerization) a solution of PHC and PNA both having a molecular weight of 2,000 in DMF are reacted, at a temperature of 65° C. and under stirring, with MDI in an isocyanate/diols molar ratio of 2.9/1. Three hours after the beginning of the reaction, the pre-polymer thus obtained is cooled to a temperature of 45° C. and diluted with DMF, until a 25% solution of pre-polymer is obtained having a content of free NCO groups of 1.46%.

DBA and water dissolved in DMF are then slowly added, maintaining a temperature of 45° C., over a period of 5 minutes, in order to have a polyurethane-polyurea having a calculated molecular weight equal to 43,000. After heating to 65° C., the reactor is kept under stirring for a further 8 hours obtaining, in the end, a polyurethane-urea solution which is stable with time having a viscosity at 20° C. of 22,000 mPa*sec. The elastomer solution thus prepared is then diluted with DMF containing Irganox® 1010 and Tinuvin® 326, with the addition of carbon black in a percentage of 4.8% with respect to PU alone, to form a solution at 14% by weight in PU. The polymer in solution thus obtained, if coagulated with water, is capable of generating structures with a high porosity.

The "semifinished product D" is immersed in the solution of the polyurethane elastomer, squeezed by passage through a pair of rolls and subsequently immersed in a water bath maintained at 40° C., for one hour. A coagulated semi-finished product is thus obtained which is passed through a water bath heated to 85° C. to extract the residual solvent and polyvinyl alcohol. The composite is then dried by passage through a heated oven.

The "coagulated and dried semi-finished product" having a thickness of 2.30 mm and grey-coloured due to the presence of carbon black in the polyurethane matrix, is then longitudinally cut to obtain two equal laminates, each having a thickness of 1.15 mm which are then subjected to grinding to remove an aliquot of the polyurethane matrix, extract the microfibre component thus forming the tassel. The grinding process is effected by using suitable abrasive papers under such conditions as to reduce the thickness of the composite material to a value of 0.85 mm, producing a microfibrous tassel having a length of 350÷400 microns (CIELAB L coordinate equal to 55.8).

The composite is finally treated in suitable dyeing machines ("jet"), in order to dye the microfibre, according to the technology traditionally used for known synthetic leathers of the suede type, within the grey or black range. In particular, the composite is passed through the "Venturi Tube" for 1 hour, operating at 125° C. in an aqueous dye bath containing the following dispersed dyes:

| | |
|---|---|
| Red dispersed dye (anthraquinonic) | 5.4% |
| Blue dispersed dye (anthraquinonic) | 22.8% |
| Yellow dispersed dye (amino ketone) | 9.4% |

At the end of the dyeing, a dyed microfibrous non-woven fabric is obtained, which, after further treatment under reducing conditions with sodium hydrosulphite in an alkaline environment to eliminate the excess dye, is subjected to finishing treatment.

The artificial leather thus obtained is subjected to analysis of the physical-mechanical properties (UNI EN 29073-3) and colour fastness to dry and wet rubbing (AATCC 8-2001), to soap washing (AATCC 61-2001), dry washing and light (SAEJ-225.6 KJ/m$^2$ and 448.8 KJ/m$^2$).

The evaluations shown in the following tables, relating to the dyed microfibrous nonwoven product, were effected as follows:

a) for the colour discharge on the test sample (multifibre felt for the washings and cloth for the rubbings) the dirt on the sample is evaluated by comparison with the ISO 105A03 grey scale;

b) for the shade exchange of the sample before and after the test, the ISO 105A02 grey scale is used.

The evaluation is effected by comparing the shade exchange or the dirty level with the shade contrasts codified by the appropriate grey scale; an evaluation equal to 5 corresponds to no change in shade/colour transfer, whereas an evaluation of 1 corresponds to the maximum contrast found on the grey scale used.

| TEST | Evaluation |
|---|---|
| Longitudinal ultimate tensile strength | 410 N |
| Transversal ultimate tensile strength | 310 N |
| Longitudinal elongation at 50 N | 4.9% |
| Transversal elongation at 50 N | 20.0% |
| Wet rubbing AATCC 8-2001 (colour discharge) | 4 |
| Dry rubbing AATCC 8-2001 (colour discharge) | 4/5 |
| Soap washing AATCC 61-2001 (colour exchange) | 5 |
| Dry washing AATCC 61-2001 (colour discharge) | 3/4 |
| Dry washing (shade exchange) | 5 |
| Dry washing (colour discharge) | 3/4 |
| Light fastness, SAE J 1885 225.6 KJ/m$^2$ (shade exchange) | 3 |
| Light fastness, SAE J 1885 488.8 KJ/m$^2$ (shade exchange) | 2/3 |

The composite material has a thickness of 0.78 mm.

Example 2 (Fast Colour from Master SSP with 1% c.b. in Fibre)

A masterbatch consisting of PET chips with the addition of carbon black at 30% by weight, is polymerized in the solid state in order to increase its Inherent viscosity (I.V.).

Polymerization is effected in the solid state (SSP) at a temperature of 203° C. and a pressure of 42 mbar for 100 hours.

The trend of the SSP process is controlled by I.V. measurements effected by means of the following analytic method: 0.5 g of masterbatch are finely ground with a specific "grinding mill", and immersed in a 50 cc solution of dichloroacetic acid, maintaining them at 85° C. for 6 hours and subsequently at 70° C. in an ultrasound bath for a further 30 minutes in order to complete the dissolution of the polymer. The solution thus obtained is then analyzed by means of a capillary viscometer of the "Ostwald" type.

By comparing the flow time used by the solution to cover a certain portion of the capillary with the time used by the solvent alone, the value of the specific viscosity is obtained. The I.V. value is obtained from the latter value using appropriate mathematical formulae.

The I.V. before and after the SSP treatment is obtained by means of the above method. The results are as follows:

I.V. masterbatch as such=0.35 dl/g

I.V. masterbatch after SSP=0.71 dl/g

The chips of masterbatch polymerized in the solid state are then added and suitably mixed, in a proportion of 1/30, with virgin PET chips (I.V. equal to 0.7 dl/g).

The chips thus mixed are then extruded and spun together with a quantity of PS, according to the procedure of the "sea-island" spinning technology, to produce a bi-component fibre whose "sea" component consists of PS and the island component consists of PET with the addition of c.b. The fibre thus obtained has the following characteristics:

1. Yarn count (denier): 4.2 dtex
2. Length: 51 mm
3. Maximum load strength: 2.18 g/tex
4. Maximum load elongation: 70%
5. Crimp number: about 4-5/cm
6. PET microfibre strength under maximum load: 3.86 g/dtex
7 Elongation of the PET microfibre under maximum load: 68%.

In particular, the fibre consists of 57 parts by weight of PET with the addition of carbon black and 43 parts by weight of PS. When observed in section, the fibre reveals the presence of 16 micro-fibres of "PET+carbon black" englobed in the PS matrix.

An intermediate felt is prepared with the bi-component fibre and is subjected to needling to form a needled felt having a density within the range of 0.170÷0.190 c/cm$^3$ and Unitary Weights within the range of 580÷630 g/m$^2$.

The needled felt, having a dark grey colour due to the presence of the fibre with the addition of carbon black (CIELAB L coordinate equal to 35.7), is immersed in an aqueous solution at 20% by weight and then subjected to drying.

The needled felt thus treated is subsequently immersed in trichloroethylene until the complete dissolution of the polystyrene matrix of the fibres. The non-woven fabric thus formed is then dried, obtaining an intermediate product called "semi-finished product D" (CIELAB L coordinate, after removal of the sea component, equal to 40.1).

A polyurethane elastomer is prepared separately, as already described in example 1. The elastomer solution thus prepared is then diluted with DMF containing Irganox® 1010 and Tinuvin® 326, with the addition of carbon black in a percentage of 4.8% with respect to the PU alone, to form a solution in PU at 14% by weight. The polymer in solution thus obtained, if coagulated in water, is capable of generating structures with high porosities.

The "semi-finished product D" is immersed in the solution of the polyurethane elastomer squeezed by passing it through a pair of rolls and subsequently immersed for 1 hour in a water bath maintained at 40° C. A coagulated semifinished product is thus obtained which is passed through a water bath heated to 85° C. to extract the residual solvent and polyvinyl alcohol. The composite material is then dried by passing it through a heated oven.

The "coagulated and dried semifinished product", having a thickness of 2.30 mm and a dark grey colour due to the presence of carbon black both in the fibre and in the polyurethane matrix, is then longitudinally cut to obtain two equal laminates, each having a thickness of 1.15 mm which are then subjected to grinding to remove an aliquot of the polyurethane matrix, to extract the microfibre component thus forming the tassel. The grinding process is effected using specific abrasive papers under such conditions as to reduce the thickness of the composite material to a value of 0.85 mm, producing a microfibrous tassel having a length of 350÷400 microns (CIELAB L coordinate equal to 33.8).

The composite is finally treated in suitable dyeing machines ("jet"), in order to over-dye the microfibre with the addition of carbon black, according to the technology traditionally used for known synthetic leathers, to give a suede type leather, coloured within the range of grey or black. In particular, the composite is passed through the "Venturi Tube" for 1 hour, operating at 125° C. in an aqueous dyeing bath containing the following dispersed dyes:

| | |
|---|---|
| Red dispersed dye (anthraquinonic) | 4% |
| Blue dispersed dye (anthraquinonic) | 3% |
| Yellow dispersed dye (amino ketone) | 3.5% |

At the end of the dyeing, a dyed microfibrous non-woven product is obtained, which, after further treatment under reducing conditions with sodium hydrosulphite in an alkaline environment to eliminate the excess dye, is subjected to finishing treatment.

The artificial leather thus obtained is subjected to analysis of the physical-mechanical properties and colour fastness, to rubbing, soap washing and a combination of dry washing and light exposure as widely described in example 1. The evaluations are shown in the following table

| TEST | Valutazione |
|---|---|
| Longitudinal ultimate tensile strength | 450 N |
| Transversal ultimate tensile strength | 248 N |
| Longitudinal elongation at 50 N | 4.5% |
| Transversal elongation at 50 N | 24.0% |
| Wet rubbing AATCC 8-2001 (colour discharge) | 4 |
| Dry rubbing AATCC 8-2001 (colour discharge) | 4/5 |
| Soap washing AATCC 61-2001 (colour exchange) | 5 |
| Dry washing AATCC 61-2001 (colour discharge) | 4/5 |
| Dry washing (shade exchange) | 5 |
| Dry washing (colour discharge) | 4/5 |
| Light fastness, SAE J 1885 225.6 KJ/m$^2$ (shade exchange) | 4/5 |
| Light fastness, SAE J 1885 488.8 KJ/m$^2$ (shade exchange) | 4 |

The composite material has a thickness of 0.79 mm.

Example 3 (Fast Colour from Master SSP with 0.4% c.b. in Fibre and Lighter Dyeing-Shade Colour)

The chips of masterbatch polymerized in the solid state as described in example 2, are added and suitably mixed to chips of virgin PET (I.V. equal to 0.7 dl/g), in a proportion of 1/75.

The chips thus mixed are then extruded and spun together with PS, according to the procedure of the "sea-island" spinning technology, to produce a bi-component fibre, whose "sea" component consists of PS and the island component consists of PET with the addition of c.b. The fibre thus obtained has the following characteristics:

1. Yarn count (denier): 4.2 dtex
2. Length: 51 mm
3. Maximum load strength: 2.09 g/tex
4. Maximum load elongation: 71%
5. Crimp number: about 4-5/cm
6. PET microfibre strength under maximum load: 3.84 g/dtex
7 Elongation of the PET microfibre under maximum load: 74%.

In particular, the fibre consists of 57 parts by weight of PET with the addition of carbon black and 43 parts by weight of PS. When observed in section, the fibre reveals the presence of 16 micro-fibres of "PET+carbon black" englobed in the PS matrix.

An intermediate felt is prepared with the bi-component fibre and is subjected to needling to form a needled felt having a density within the range of 0.204÷0.208 c/cm$^3$ and Unitary Weights within the range of 550÷580 g/m$^2$.

The needled felt, having a dark grey colour due to the presence of the fibre containing carbon black (CIELAB L coordinate equal to 50.4), is immersed in an aqueous solution at 20% by weight and then subjected to drying.

The needled felt thus treated is subsequently immersed in trichloroethylene until the complete dissolution of the polystyrene matrix of the fibres. The non-woven fabric thus formed is then dried, obtaining an intermediate product called "semi-finished product D" (CIELAB L coordinate, after removal of the sea component, equal to 51.6).

A polyurethane elastomer is prepared separately, as already described in example 1. The elastomer solution thus prepared is then diluted with DMF containing Irganox® 1010 and Tinuvin® 326, with the addition of carbon black in a percentage of 0.3% with respect to the PU alone, to form a solution in PU at 14% by weight The polymer in solution thus obtained, if coagulated in water, is capable of generating structures with high porosities.

The "semi-finished product D" is immersed in the solution of the polyurethane elastomer squeezed by passing it through a pair of rolls and subsequently immersed for 1 hour in a water bath maintained at 40° C. A coagulated semifinished product is thus obtained which is passed through a water bath heated to 85° C. to extract the residual solvent and polyvinyl alcohol. The composite material is then dried by passing it through a heated oven.

The "coagulated and dried semifinished product", having a thickness of 2.30 mm and a dark grey colour due to the presence of carbon black both in the fibre and in the polyurethane matrix, is then longitudinally cut to obtain two equal laminates, each having a thickness of 1.15 mm which are then subjected to grinding to remove an aliquot of the polyurethane matrix, extract the microfibre component and thus form the tassel. The grinding process is effected by using specific abrasive papers under such conditions as to reduce the thickness of the composite material to a value of 0.85 mm, producing a microfibrous tassel having a length of 300÷350 microns (CIELAB L coordinate equal to 50.0).

The composite is finally treated in suitable dyeing machines ("jet"), in order to over-dye the microfibre containing carbon black, according to the technology traditionally used for known synthetic leathers, to give a suede-type leather, coloured within the grey or black range.

Unlike what has been observed with the composite materials previously illustrated, the lower amount of carbon black used makes it necessary to use a higher quantity of dyes, if the final colour desired is the same. Starting from a lighter grey shade, on the contrary, a range of lighter colours can be obtained, by over-dyeing, which would otherwise be impossible to produce starting from the grey base of the composite previously illustrated (example 2), in any case maintaining equally high colour fastness performances.

In particular, the composite is passed through the "Venturi Tube" for 1 hour, operating at 125° C. in an aqueous dyeing bath containing the following dispersed colours:

| | |
|---|---|
| Red dispersed dye (anthraquinonic) | 0.7% |
| Blue dispersed dye (anthraquinonic) | 1.9% |
| Yellow dispersed dye (amino ketone) | 0.5% |

At the end of the dyeing, a dyed microfibrous non-woven fabric is obtained, which, after further treatment under reducing conditions with sodium hydrosulphite in an alkaline environment to eliminate the excess dye, is subjected to finishing treatment.

The artificial leather thus obtained is subjected to analysis of the physical-mechanical properties and colour fastness to rubbing, soap washing and a combination of dry washing and light exposure as widely described in example 1. The evaluations are indicated in the following table

| TEST | Valutazione |
|---|---|
| Longitudinal ultimate tensile strength | 410 N |
| Transversal ultimate tensile strength | 240 N |
| Longitudinal elongation at 50 N | 5.5% |
| Transversal elongation at 50 N | 25.0% |
| Wet rubbing AATCC 8-2001 (colour discharge) | 4 |
| Dry rubbing AATCC 8-2001 (colour discharge) | 4/5 |
| Soap washing AATCC 61-2001 (colour exchange) | 5 |
| Dry washing AATCC 61-2001 (colour discharge) | 4/5 |
| Dry washing (shade exchange) | 5 |
| Dry washing (colour discharge) | 4/5 |
| Light fastness, SAE J 1885 225.6 KJ/m$^2$ (shade exchange) | 4/5 |
| Light fastness, SAE J 1885 488.8 KJ/m$^2$ (shade exchange) | 4 |

The composite material has a thickness of 0.80 mm.

By comparison, a composite produced with the same procedure, starting however from virgin PET fibres (with no addition of carbon black), required, in order to obtain the same colour shade, the use of a dyeing bath with the following dispersed dyes

| | |
|---|---|
| Red dispersed dye (anthraquinonic) | 1.3% |
| Blue dispersed dye (anthraquinonic) | 3.8% |
| Yellow dispersed dye (amino ketone) | 1.3% |

Example 4—(Non-Regraded Fast Colour with 1% Carbon Black in Fibre)

The chips of masterbatch as such (containing PET with the addition of carbon black at 30% by weight, I.V. equal to 0.35 dl/g), are added to and suitably mixed, in a proportion of 1/30, with chips of virgin PET (I.V. of 0.7 dl/g).

The chips thus mixed are then extruded and spun together with PS, according to the "sea-island" spinning technology, to produce a bi-component fibre, whose sea component consists of PS and the island component consists of PET with the addition of carbon black. The fibre thus obtained has the following characteristics:

1. Yarn count (denier): 4.2 dtex
2. Length: 51 mm
3. Maximum load strength: 1.45 g/tex
4. Maximum load elongation: 69%
5. Crimp number: about 4-5/cm
6. PET microfibre strength under maximum load: 2.55 g/dtex
7 Elongation of the PET microfibre under maximum load: 72%.

In particular, the fibre consists of 57 parts by weight of PET with the addition of carbon black and 43 parts by weight of PS. When observed in section, the fibre reveals the presence of 16 micro-fibres of "PET+carbon black" englobed in the PS matrix.

An intermediate felt is prepared with the bi-component fibre and is subjected to needling to form a needled felt having a density within the range of 0.240÷0.260 c/cm$^3$ and Unitary Weights within the range of 630÷650 g/m$^2$. Also during the production of the felt, problems were observed relating to the breakage of the microfibre, which causes a sudden increase in density and frequent needle breaks.

The needled felt, having a dark-grey colour due to the presence of the fibre with the addition of carbon black (CIELAB L coordinate equal to 35.4), is immersed in an aqueous solution of polyvinyl alcohol at 20% by weight and then subjected to drying.

The needled felt thus treated is subsequently immersed in trichloroethylene until the complete dissolution of the polystyrene matrix of the fibres. The non-woven fabric thus formed is then dried, obtaining an intermediate product called "semi-finished product D" (CIELAB L coordinate, after removal of the sea component, equal to 40.3).

A polyurethane elastomer is prepared separately, as already described in example 1. The elastomer solution thus prepared is then diluted with DMF containing Irganox® 1010 and Tinuvie 326, with the addition of carbon black in a percentage of 4.8% with respect to the PU alone, to form a solution in PU at 14% by weight. The polymer in solution thus obtained, if coagulated in water, is capable of generating structures with high porosities.

The "semi-finished product D" is immersed in the solution of the polyurethane elastomer, squeezed by passing it through a couple of rolls and subsequently immersed for 1 hour in a water bath maintained at 40° C. A coagulated semifinished product is thus obtained which is passed through a water bath heated to 85° C. to extract the residual solvent and polyvinyl alcohol. The composite material is then dried by passing it through a heated oven.

The "coagulated and dried semifinished product", having a thickness of 2.30 mm and a dark grey colour due to the presence of carbon black both in the fibre and in the polyurethane matrix, is then longitudinally cut to obtain two equal laminates, each having a thickness of 1.15 mm which are then subjected to grinding to remove an aliquot of the polyurethane matrix, extract the microfibre component and thus form the tassel. The grinding process is effected by using suitable abrasive papers under such conditions as to reduce the thickness of the composite material to a value of 0.85 mm, producing a microfibrous tassel having a length of 320÷370 microns (CIELAB L coordinate equal to 34.0).

The composite is finally treated in suitable dyeing machines ("jet"), in order to over-dye the microfibre containing carbon black, according to the technology traditionally used for known synthetic leathers, to give a suede-type leather, coloured within the grey or black range. In particular, the composite is passed through the "Venturi Tube" for 1 hour, operating at 125° C. in an aqueous dyeing bath containing the following dispersed colours:

| | |
|---|---|
| Red dispersed dye (anthraquinonic) | 4% |
| Blue dispersed dye (anthraquinonic) | 3% |
| Yellow dispersed dye (amino ketone) | 3.5% |

At the end of the dyeing, a dyed microfibrous non-woven fabric is obtained, which, after further treatment under reducing conditions with sodium hydrosulphite in an alkaline environment to eliminate the excess dye, is subjected to finishing treatment.

The artificial leather thus obtained is subjected to analysis of the physical-mechanical properties and colour fastness to rubbing, soap washing and a combination of dry washing and light exposure as widely described in example 1. The evaluations are indicated in the following table

| TEST | Evaluation |
|---|---|
| Longitudinal ultimate tensile strength | 424 N |
| Transversal ultimate tensile strength | 272 N |

-continued

| TEST | Evaluation |
|---|---|
| Longitudinal elongation at 50 N | 3.6% |
| Transversal elongation at 50 N | 22.0% |
| Wet rubbing AATCC 8-2001 (colour discharge) | 4 |
| Dry rubbing AATCC 8-2001 (colour discharge) | 4/5 |
| Soap washing AATCC 61-2001 (colour exchange) | 5 |
| Dry washing AATCC 61-2001 (colour discharge) | 4/5 |
| Dry washing (shade exchange) | 5 |
| Dry washing (colour discharge) | 4/5 |
| Light fastness, SAE J 1885 225.6 KJ/m$^2$ (shade exchange) | 4/5 |
| Light fastness, SAE J 1885 488.8 KJ/m$^2$ (shade exchange) | 4 |

The composite has a thickness of 0.82 mm.

Example 5 (Non-Regraded Fast Colour with 2% Carbon Black in Fibre)

The chips of masterbatch as such (containing PET with the addition of 30% by weight of carbon black, I.V. equal to 0.35 dl/g), are added to and suitably mixed, in a proportion of 1/15, with chips of virgin PET (I.V. of 0.7 dl/g).

The chips thus mixed are then extruded and spun together with PS, according to the "sea-island" spinning technology, to produce a bi-component fibre, whose sea component consists of PS and the island component consists of PET with the addition of carbon black. The fibre thus obtained has the following characteristics:

1. Yarn count (denier): 4.2 dtex
2. Length: 51 mm
3. Maximum load strength: 1.4 g/tex
4. Maximum load elongation: 62%
5. Crimp number: about 4-5/cm
6. PET microfibre strength under maximum load: 2.52 g/dtex
7 Elongation of the PET microfibre under maximum load: 72%.

In particular, the fibre consists of 57 parts by weight of PET containing carbon black and 43 parts by weight of PS. When observed in section, the fibre reveals the presence of 16 microfibres of "PET+carbon black" englobed in the PS matrix.

An intermediate felt is prepared with the bi-component fibre and is subjected to needling to form a needled felt having a density within the range of 0.240÷0.260 c/cm$^3$ and Unitary Weights within the range of 615÷630 g/m$^2$.

The needled felt, having a dark grey colour due to the presence of the fibre containing carbon black (CIELAB L coordinate equal to 25.0), is immersed in an aqueous solution of polyvinyl alcohol at 20% by weight and then subjected to drying.

The needled felt thus treated is subsequently immersed in trichloroethylene until the complete dissolution of the polystyrene matrix of the fibres. The non-woven fabric thus formed is then dried, obtaining an intermediate product called "semi-finished product D" (CIELAB L coordinate, after removal of the sea component, equal to 30.3).

A polyurethane elastomer is prepared separately, as already described in example 1. The elastomer solution thus prepared is then diluted with DMF containing Irganox® 1010 and Tinuvin® 326, with the addition of carbon black in a percentage of 4.8% with respect to the PU alone, to form a solution in PU at 14% by weight. The polymer in solution thus obtained, if coagulated in water, is capable of generating structures with high porosities.

The "semi-finished product D" is immersed in the solution of the polyurethane elastomer, squeezed by passing it through a pair of rolls and subsequently immersed for 1 hour in a water bath maintained at 40° C. A coagulated semifinished product is thus obtained which is passed through a water bath heated to 85° C. to extract the residual solvent and polyvinyl alcohol. The composite material is then dried by passing it through a heated oven.

The "coagulated and dried semifinished product", having a thickness of 2.30 mm and dark-grey colour due to the presence of carbon black both in the fibre and in the polyurethane matrix, is then longitudinally cut to obtain two equal laminates, each having a thickness of 1.15 mm which are then subjected to grinding to remove an aliquot of the polyurethane matrix, extract the microfibrous component and thus form the tassel. The grinding process is effected by using suitable abrasive papers under such conditions as to reduce the thickness of the composite material to a value of 0.85 mm, producing a microfibrous tassel having a length of 320÷370 microns (CIELAB L coordinate equal to 24.4).

The composite is finally treated in suitable dyeing machines ("jet") in order to over-dye the microfibre containing carbon black, according to the technology traditionally used for already known synthetic leathers, to give a suede-type leather coloured within the grey and black range.

Unlike what has been observed with the composite products described above, the higher quantity of carbon black used does not allow the same colour range to be reproduced, starting from the composite products already described. The colours listed in the following table, for example, characterized by high sales volumes, cannot be prepared starting from the present composite product due to the greater brightness of the colour shade required with respect to that of the composite produced (CIELAB L coordinate equal to 24.4)

| Colour | L |
|---|---|
| 6650 | 29.86 |
| 6750 | 26.89 |
| 6950 | 32.87 |

For other colours, on the other hand, difficulties are observed for reaching the desired colour shade by means of over-dyeing due to the strong colour changes towards red and/or blue shades of the composite product and to the poor contribution of the dyes necessary for effecting the shade correction. The smaller colour range which can be developed on this colour base of the composite product, however, is coupled by a strong increase in resistance on particularly dark colours (black in particular) which in any case require considerable additions of dyes even when starting from the composite product described in examples 2 and 4.

In particular, the composite is passed through the "Venturi Tube" for 1 hour, operating at 125° C. in an aqueous dyeing bath containing the following dispersed dyes:

| | |
|---|---|
| Red dispersed dye (anthraquinonic) | 1% |
| Blue dispersed dye (anthraquinonic) | 3% |
| Yellow dispersed dye (amino ketone) | 10.5% |

At the end of the dyeing, a dyed microfibrous non-woven fabric is obtained, which, after further treatment under reducing conditions with sodium hydrosulphite in an alkaline environment to eliminate the excess dye, is subjected to finishing treatment.

The artificial leather thus obtained is subjected to analysis of the physical-mechanical properties and colour fastness to rubbing, soap washing and the combination of dry washing and light exposure as widely described in example 1. The evaluations are indicated in the following table

| TEST | Evaluation |
|---|---|
| Longitudinal ultimate tensile strength | 395 N |
| Transversal ultimate tensile strength | 240 N |
| Longitudinal elongation at 50 N | 7.0% |
| Transversal elongation at 50 N | 32.0% |
| Wet rubbing AATCC 8-2001 (colour discharge) | 4 |
| Dry rubbing AATCC 8-2001 (colour discharge) | 4/5 |
| Soap washing AATCC 61-2001 (colour exchange) | 5 |
| Dry washing AATCC 61-2001 (colour discharge) | 4/5 |
| Dry washing (shade exchange) | 5 |
| Dry washing (colour discharge) | 4/5 |
| Light fastness, SAE J 1885 225.6 $KJ/m^2$ (shade exchange) | 4/5 |
| Light fastness, SAE J 1885 488.8 $KJ/m^2$ (shade exchange) | 4/5 |

The composite has a thickness of 0.76 mm.

By comparison, a compound prepared with the same procedure but starting from virgin PET fibre (with no addition of carbon black) required, in order to obtain the same colour shade, the use of a dyeing bath with the following dispersed dyes:

| | |
|---|---|
| Red dispersed dye (anthraquinonic) | 5.7% |
| Blue dispersed dye (anthraquinonic) | 12.8% |
| Yellow dispersed dye (amino ketone) | 18.1% |

Comparative Example 6 (Fast Colour from Master SSP with 1% Carbon Black in Fibre and Short Tassel)

The composite product, prepared as described in example 2, was ground under such conditions as to produce a micro-fibrous tassel having a length ranging from 90 to 120 μm (CIELAB L coordinate equal to 33.4).

The composite is finally treated in suitable dyeing machines ("jet"), in order to over-dye the microfibre containing carbon black, according to the technology traditionally used for known synthetic leathers of the suede type, within the range of grey or black. In particular, the composite is passed through the "Venturi Tube" for 1 hour, operating at 125° C. in an aqueous dyeing bath containing the following dispersed dyes:

| | |
|---|---|
| Red dispersed dye (anthraquinonic) | 3.8% |
| Blue dispersed dye (anthraquinonic) | 2.8% |
| Yellow dispersed dye (amino ketone) | 3.2% |

At the end of the dyeing, a dyed microfibrous non-woven is obtained, which, after further treatment under reducing conditions with sodium hydrosulphite in an alkaline environment to eliminate the excess dye, is subjected to finishing treatment.

The artificial leather thus obtained shows an evident qualitative decay from an aesthetical point of view due to the excessive exposure of the polyurethane background and to the loss of the writing and marbling effect caused by the particularly short microfibrous tassel. Prototypes of composite products thus produced were considered as being unsuitable by the final user and therefore discarded.

The evaluation of the physical-mechanical properties and colour resistance tests to rubbing, soap washing and a combination of dry washings and light exposures (already widely described in example 1), are indicated in the following table

| TEST | Evaluation |
|---|---|
| Longitudinal ultimate tensile strength | 445 N |
| Transversal ultimate tensile strength | 250 N |
| Longitudinal elongation at 50 N | 4.3% |
| Transversal elongation at 50 N | 23.0% |
| Wet rubbing AATCC 8-2001 (colour discharge) | 4 |
| Dry rubbing AATCC 8-2001 (colour discharge) | 4/5 |
| Soap washing AATCC 61-2001 (colour exchange) | 5 |
| Dry washing AATCC 61-2001 (colour discharge) | 4/5 |
| Dry washing (shade exchange) | 5 |
| Dry washing (colour discharge) | 4/5 |
| Light fastness, SAE J 1885 225.6 KJ/m$^2$ (shade exchange) | 4/5 |
| Light fastness, SAE J 1885 488.8 KJ/m$^2$ (shade exchange) | 4 |

The composite product has a thickness of 0.78 mm.

Summarizing Table

The main characteristics of the composite materials described above are summarized hereunder, for a clearer and more convenient reading.

Comparative example 1 refers to the production of artificial suede leather with no carbon black in the micro-fibrous part.

Comparative example 6 refers to the production of suede leather having a tassel length of 90-120 microns.

| TEST | 1C | 2 | 3 | 4 | 5 | 6C |
|---|---|---|---|---|---|---|
| I.V. masterbatch (dl/g) | — | 0.71 | 0.71 | 0.35 | 0.35 | 0.71 |
| c.b. microfibre content (%) | 0 | 1 | 0.4 | 1 | 2 | 1 |
| c.b. elastomer content (%) | 4.8 | 4.8 | 0.3 | 4.8 | 4.8 | 4.8 |
| c.b. total content (%) | 1.6 | 2.3 | 0.4 | 2.3 | 2.9 | 2.3 |
| fibre count (dtex) | 4.2 | 4.2 | 4.2 | 4.2 | 4.2 | 4.2 |
| fibre toughness (g/dtex) | 2.08 | 2.18 | 2.09 | 1.45 | 1.40 | 2.18 |
| fibre elongation (%) | 62 | 70 | 71 | 69 | 62 | 70 |
| PET microfibre toughness (g/dtex) | 3.89 | 3.86 | 3.84 | 2.55 | 2.52 | 3.86 |
| PET microfibre elongation (%) | 72 | 68 | 74 | 72 | 72 | 68 |
| felt luminosity (L) | 96.3 | 35.7 | 50.4 | 35.4 | 25.0 | 35.7 |
| composite luminosity (L) | 55.8 | 33.8 | 50.0 | 34.0 | 24.4 | 33.4 |
| tassel length (μm) | 350-400 | 320-370 | 300-350 | 320-370 | 320-370 | 90-120 |
| Fastness to light, SAE J 1885 225.6 KJ/m$^2$ (shade exchange) | 3 | 4/5 | 4 (4/5*) | 4/5 | (4/5*) | 4/5 |
| Fastness to light, SAE J 1885 488.8 KJ/m$^2$ (shade exchange) | 2/3 | 4 | 3/4 (4*) | 4 | (4/5*) | 4 |

(*) the value relates to a different colour shade

From observing the summarizing table, the following conclusions can be made:

- the addition of carbon black to the microfibre during spinning allows a considerable increase in the colour fastness of the dye to light, even of 1-1.5 with respect to the grey scale (see examples 1C and 2);
- by increasing the carbon black content in the fibre, the colour fastness to light increases but the colour range which can be obtained starting from the intermediate microfibrous compound decreases (decrease in the luminosity value L of the same intermediate product);
- the addition of masterbatch containing carbon black causes a slight decrease in the physical-mechanical properties of the fibre;
- the masterbatch polymerization process in the solid state (see examples 2 and 3) allows the production of a microfibre with improved mechanical properties, comparable with that of the reference product, without carbon black, described in comparative example 1.

The invention claimed is:

1. A process for the production of an artificial leather having a suede appearance, a color fastness to light, higher than or equal to 4, according to the method SAE J 1885 225.6 KJ/m$^2$, and a color fastness to light not lower than 3, according to the method SAE J 1885 488.8 KJ/m$^2$, said process comprising the following steps:

a) spinning bi-component fibers of the "sea-island" type, in which the "island" component consists of a polyester and 0.05% to 2% by weight of carbon black and the "sea" component consists of a polymer immiscible with the island component;

b) preparing a mono-layer felt by connecting the bi-component fibers through needle punching;

c) impregnating the mono-layer felt with a polyurethane (PU) or a polyurethane dispersion (PUD) binder capable of withholding the "island" component during the subsequent elimination phase of the "sea" component;

d) dissolving the "sea" component with an organic solvent to give a microfibrous intermediate product;

e) impregnating the microfibrous intermediate product with an elastomeric matrix solution and/or dispersion comprising one or more polyurethanes and carbon black, the latter being present in a quantity of 0.02 to 6% by weight, with respect to the polyurethane, said polyurethane being made up of soft segments and hard segments, said soft segments consisting of at least one polyalkylene carbonate diol and at least one polyester diol; said hard segments consisting of urethane and/or ureic groups deriving from the reaction between free isocyanate groups and water;

f) eliminating the organic solvent to give a raw semi-finished product;

g) grinding the surface of the raw semi-finished product to yield ground raw semi-finished product having a suede appearance; and h) overdyeing the ground raw semi-finished product with dispersed dyes to obtain an artificial leather having a suede appearance, a color fastness to light higher than or equal to 4, according to the method SAE J 1885

225.6 KJ/m$^2$, and a color fastness to light not lower than 3, according to the method SAE J 1885 488.8 KJ/m$^2$.

2. The process according to claim 1, wherein the polyester containing the carbon black has an Inherent Viscosity (I.V.) value not lower than that of the other polyester.

3. The process according to claim 1, wherein carbon black is contained in the microfibres in a quantity of 0.15 to 1.50% by weight.

4. The process according to claim 1, wherein the microfibres are polyethylene terephthalate, polytrimethylene terephthalate, or polybutylene terephthalate.

5. The process according to claim 4, wherein the microfibres are polyethylene terephthalate microfibres.

6. The process according to claim 4, wherein the microfibres are previously subjected to a polymerization processes in the solid state to increase the length of the polymeric chains.

7. The process according to claim 1, wherein the dyeing step is conducted at a temperature ranging from 100° C. to 140° C.

8. The process according to claim 1, wherein the carbon black has an average particle-size less than 0.4 microns.

9. The process according to claim 1, wherein the ratio between the elastomer matrix and the microfibrous component ranges from 20/80 to 50/50 by mass.

10. The process according to claim 1, wherein part of the microfibrous component forms tassels on a surface of the artificial leather having a length from 200 to 500 μm.

11. The process according to claim 10, wherein length of the tassels range from 210 to 400 μm.

12. The process according to claim 1, wherein the artificial leather is a non-woven artificial leather.

13. The process according to claim 1, wherein the microfibrous component comprising polyester microfibres having a count of 0.01 to 0.50 dtex.

14. The process according to claim 1, wherein the polyester diols are selected from the group consisting of polyhexamethylene adipate diol (PHA), poly(3-methylpentamethylene) adipate diol (PMPA), polyneopentyl adipate diol (PNA), and polycaprolactone diol (PCL);

the polyalkylenecarbonate diols are selected from the group consisting of polytetramethylene carbonate diol (PTMC), polypentamethylene carbonate diol (PPMC), polyhexamethylene carbonate diol (PHC), polyheptamethylene carbonate diol, polyoctamethylene carbonate diol, polynonamethylene carbonate diol, polydecamethylene carbonate diol, poly-(2-methyl-pentamethylene carbonate)diol, and poly-(2-methyl-1-octamethylene carbonate) diol; and the isocyanate groups derive from methylene-bis-(4-phenylisocyanate) (MDI) and/or from toluene diisocyanate (TDI).

15. The process according to claim 1, wherein the polyester diol is polyhexamethylene adipate diol (PHA).

16. The process according to claim 1, wherein the hard segments of said polyurethane further comprise one or more compounds selected from the group consisting of 2,2-dimethylol-propanoic acid, 2,2-dimethylol-butanoic acid, N-methyl-diethanolamine, dihydroxy alkyl amines, di-amino-alkyl amines, quaternary ammonium salts, and polyoxyalkyl ethers.

17. A process for the production of an artificial leather having a suede appearance, a color fastness to light, higher than or equal to 4, according to the method SAE J 1885 225.6 KJ/m$^2$, and a color fastness to light not lower than 3, according to the method SAE J 1885 488.8 KJ/m$^2$, said process comprising the following steps:

a) spinning bi-component fibers of the "sea-island" type, in which the "island" component consists of a polyester and 0.05% to 2% by weight of carbon black and the "sea" component consists of a polymer immiscible with the island component;

b) preparing a mono-layer felt by connecting the bi-component fibers through needle punching;

c) impregnating the mono-layer felt with a polyvinyl alcohol (PVA) binder capable of withholding the "island" component during the subsequent elimination phase of the "sea" component;

d) dissolving the "sea" component with an organic solvent to give a microfibrous intermediate product;

e) impregnating the microfibrous intermediate product with an elastomeric matrix solution and/or dispersion comprising one or more polyurethanes and carbon black, the latter being present in a quantity of 0.02 to 6% by weight, with respect to the polyurethane, said polyurethane being made up of soft segments and hard segments, said soft segments consisting of at least one polyalkylene carbonate diol and at least one polyester diol; said hard segments consisting of urethane and/or ureic groups deriving from the reaction between free isocyanate groups and water;

f) eliminating the organic solvent and binder to give a raw semi-finished product;

g) grinding the surface of the raw semi-finished product to yield ground raw semi-finished product having a suede appearance; and h) overdyeing the ground raw semi-finished product with dispersed dyes to obtain an artificial leather having a suede appearance, a color fastness to light higher than or equal to 4, according to the method SAE J 1885 225.6 KJ/m$^2$, and a color fastness to light not lower than 3, according to the method SAE J 1885 488.8 KJ/m$^2$.

* * * * *